US008434546B1

(12) United States Patent
Heitkamp et al.

(10) Patent No.: US 8,434,546 B1
(45) Date of Patent: May 7, 2013

(54) CASTING MOLD CORE RETENTION DEVICE AND METHOD

(75) Inventors: Brad Heitkamp, Minster, OH (US); Brad Eshleman, Minster, OH (US); Tyron Grieshop, Maria Stein, OH (US); Bryan Dahms, Carey, OH (US)

(73) Assignee: Honda Motor Co., Ltd., Tokyo (JP)

( * ) Notice: Subject to any disclaimer, the term of this patent is extended or adjusted under 35 U.S.C. 154(b) by 335 days.

(21) Appl. No.: 12/750,122

(22) Filed: Mar. 30, 2010

(51) Int. Cl.
*B22D 33/04* (2006.01)
*B22C 21/14* (2006.01)

(52) U.S. Cl.
USPC ..... 164/340; 164/397

(58) Field of Classification Search ..... 164/340, 164/137, 397–400
See application file for complete search history.

(56) References Cited

U.S. PATENT DOCUMENTS

| | | | | |
|---|---|---|---|---|
| 1,567,605 | A | 12/1925 | Lee | |
| 2,161,521 | A | 6/1939 | McWane | |
| 2,789,329 | A | 4/1957 | Peterson et al. | |
| 4,691,754 | A | 9/1987 | Trumbauer et al. | |
| 4,913,217 | A | 4/1990 | Koch et al. | |
| 4,981,168 | A | 1/1991 | Koch et al. | |
| 5,119,881 | A | 6/1992 | Cagle | |
| 5,392,841 | A | 2/1995 | Anderson et al. | |
| 5,704,412 | A | 1/1998 | Gurdebeke | |
| 6,145,578 | A * | 11/2000 | Zearbaugh et al. | 164/340 |
| 6,478,073 | B1 | 11/2002 | Grebe et al. | |
| 6,865,806 | B2 | 3/2005 | Wildrick et al. | |
| 6,942,007 | B2 | 9/2005 | Meyer | |
| 7,172,012 | B1 | 2/2007 | Memmen | |
| 2002/0050334 | A1 | 5/2002 | Dodd | |
| 2006/0108084 | A1 | 5/2006 | Bassi | |
| 2007/0131377 | A1 | 6/2007 | Suzuki et al. | |
| 2008/0017346 | A1 | 1/2008 | Bassi | |
| 2009/0139680 | A1 | 6/2009 | Maeyama et al. | |
| 2009/0183852 | A1 | 7/2009 | Bassi | |

FOREIGN PATENT DOCUMENTS

| | | | |
|---|---|---|---|
| DE | 215995 | A1 | 11/1984 |
| DE | 20221850 | U1 | 12/2008 |
| FR | 2872722 | A1 | 1/2006 |
| JP | 10-71451 | A | 3/1988 |
| JP | 63-60061 | A | 3/1988 |
| JP | 2000-33459 | A | 2/2000 |
| JP | 2003-39137 | A | 2/2003 |
| JP | 2004-230403 | A | 8/2004 |
| JP | 2006-297414 | A | 11/2006 |
| JP | 2008-771 | A | 1/2008 |

* cited by examiner

*Primary Examiner* — Kevin P Kerns
*Assistant Examiner* — Steven Ha
(74) *Attorney, Agent, or Firm* — Standley Law Group LLP

(57) ABSTRACT

A device and method for retaining the position of a core in a casting mold, such as a vehicle cylinder head casting mold. The core may be a port core, such as an exhaust port core. A plunger assembly is arranged in the mold to produce a substantially unidirectional pressing force against a supported end of the core. Due to the shape of the core and its orientation and arrangement with respect to the mold, the substantially unidirectional force exerted by the pin also creates a moment that results in an additional pressing force component that is substantially perpendicular to the direction of the pressing force exerted by the pin. This second force component presses contacting ends at the other end of the core into tight contact with an associated molding surface. Consequently, the plunger assembly produces a retention force on the core in two directions.

20 Claims, 5 Drawing Sheets

CASTING MOLD CORE RETENTION DEVICE AND METHOD

TECHNICAL FIELD

The present invention is directed to a device and method for retaining the position of a core within a metal casting mold. More particularly, the present invention is directed to a device and method for retaining the position of an internal combustion engine port core during a casting operation.

BACKGROUND OF THE INVENTIVE FIELD

The casting of metallic parts is a well known manufacturing technique. Metal casting is typically accomplished by introducing a molten, generally non-ferrous, metal (e.g., aluminum) into a closed die (mold). After metal introduction, the cast part is cooled and the formed part is removed from the mold.

Casting can be used to form parts of complex shape and, therefore, is commonly used in the automotive industry. For example, aluminum casting has become increasingly used to manufacture vehicle engine parts. Some of these parts may require that a cavity, port, passageway, and/or other hollow area be formed therein. To that end, it is known to locate a core within a casting mold. Such cores are frequently made of sand when the casting process does not employ high clamping and metal injection pressures. The core remains in the mold during the introduction of molten metal to form the necessary hollow feature(s) within the finished part. Once the part has cooled, the part and the core are removed from the mold, and the core is subsequently removed from the part by any of various techniques known to those of skill in the art.

One difficulty associated with the use of such a core is that the core must be retained in an intended position within the mold in order to properly form the desired feature(s) in the cast part. This has proven problematic. For example, one particular problem is the tendency of such a core to move or "float" away from its proper position under the force of injected molten metal. The result of such core displacement may be a malformed feature in the cast part, such as a cavity or aperture that is partially or wholly covered by flash.

Core float and improper part formation is a problem known to occur during the casting of vehicle engine cylinder heads. For example, during a cylinder head casting operation, the complex shape of an associated exhaust port core (see FIG. 1*a*), its position within a cylinder head casting mold, and the nature of the mold, can result in a displacement or floating of the core during the introduction of molten metal—even in a low pressure casting operation. Such a displacement of the exhaust port core can result in, among other problems, partially formed or unformed exhaust ports (see FIG. 1*b*).

Producing a cylinder head with partially formed or unformed exhaust ports is obviously undesirable, as the result is either the need for additional machining or a scrap part. Therefore, it can be understood that a technique for retaining a core in proper position during a cylinder head casting operation is desirable. The present invention is directed to a device and method for such core retention.

SUMMARY OF THE GENERAL INVENTIVE CONCEPT

The present invention is directed to a device and method for retaining a core, such as a vehicle engine exhaust port core, in proper position during a casting operation. The present invention takes advantage of the shape of the core to create both a horizontally directed and vertically directed holding force from a unidirectional pressing force.

A device of the present invention generally includes at least one pin for pressing on the core when the core is properly positioned in a closed casting mold. The pin may be located in a cavity within the mold and is associated with a spring. Together, the pin and spring form a plunger that exerts a pressing force on the core. The presence of the spring and the cavity in which the pin resides also allows the pin to be displaced under sufficient resistance. Consequently, the plunger is able to exert a desired pressing force on the core without damaging the core should the mold and or core experience thermal expansion, etc. Conversely, the plunger is also able to exert a desired pressing force on the core even if the mold cavity experiences some amount of dimensional growth due to wear.

As mentioned above, the present invention takes advantage of the shape of the core and its orientation and arrangement with respect to the mold to create both a horizontally directed and vertically directed holding force from a unidirectional pressing force. For example, in one exemplary embodiment the aforementioned plunger is arranged in the mold to exert a substantially horizontally directed pressing force against one end of the core. Thus, horizontal movement of the core within the mold is eliminated or at least greatly minimized.

Due to the shape of the core and its orientation and suspended arrangement with respect to the mold, this substantially horizontally directed pressing force also creates a moment that results in a non-horizontal (downward in this case) force component. This non-horizontal force component presses the core tightly against a supporting portion of the mold and resists the counterforce produced when molten metal is introduced into the mold. Consequently, it can be ensured that vertical movement (floating) of the core within the mold during molten metal introduction is also eliminated or at least greatly minimized.

In certain embodiments of the present invention, the plunger assembly may be installed directly into a cavity or cavities provided in the mold. In other embodiments, the plunger assembly may be contained in a module that is installed into a corresponding receiving cavity in the mold. The use of such a module may simplify the installation and removal of a plunger, such as may be required for maintenance, etc.

It is contemplated that a device and method of the present invention may interact with special features of an associated mold to form an overall system that further improves core retention. For example, a protrusion (e.g., button) or another similar feature may be provided on a mold at a point of contact with an associated core. A corresponding receiving feature may then be provided on the core so that when the core is properly located in the mold, engagement of the corresponding features helps to retain the position of the core. When this option is employed, the mold and the core will generally be provided with corresponding male and female features. Either feature may appear on the mold, with the corresponding feature appearing on the core.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Casting molds are well known to those of skill in the art. Briefly, such molds typically comprise a moving portion(s) and a stationary portion(s) that, when combined, form a complete mold within which a part may be cast. When forming complex parts, these molds may include removable cores. Such cores may be formed from various materials but, in lower pressure casting operations, cores are commonly formed from sand to reduce cost.

Figure 1A:
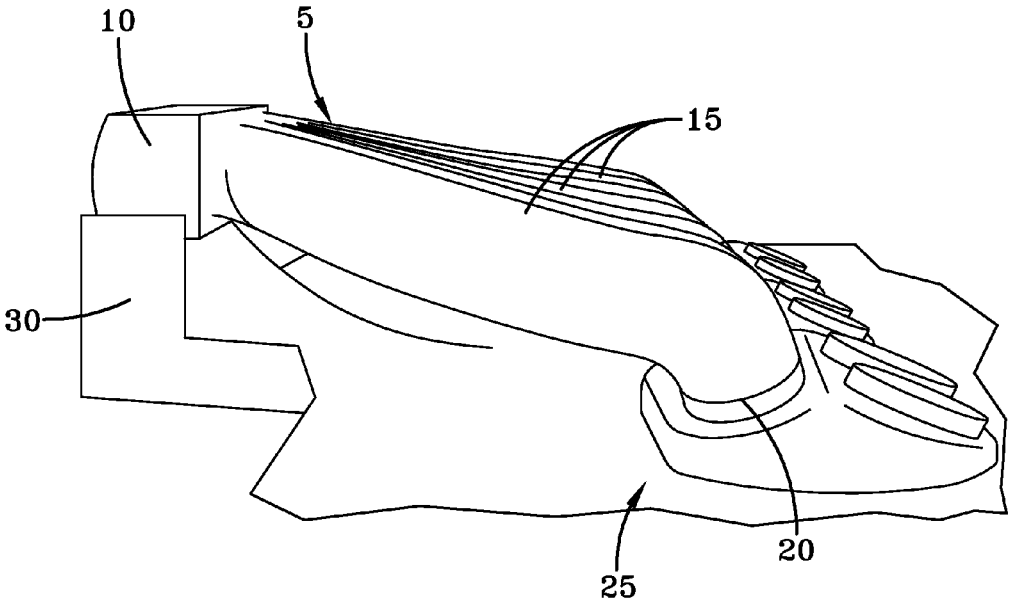
FIG. 1*a* depicts an exemplary exhaust port core and mold portion for use in a vehicle engine cylinder head casting operation.

An exemplary vehicle engine exhaust port core (hereinafter "port core") 5 and a lower section of an associated cylinder head mold 25 are depicted in FIG. 1*a*. As shown, this particular port core 5 includes a neck portion 10 that rests on a corresponding mold element 30 when the port core is installed to the lower mold section 25. The port core 5 also includes a series of individual runners 15 that extend from the neck portion 10 to contact a cylinder forming feature of the mold section 25. The runners 15 form exhaust passages in a cylinder head 35 (see FIG. 1*b*) during an associated casting operation. The contacting ends 20 of the runners 15 are adapted to form exhaust valve openings within combustion chamber portions of the cylinder head 35.

Figure 1B:
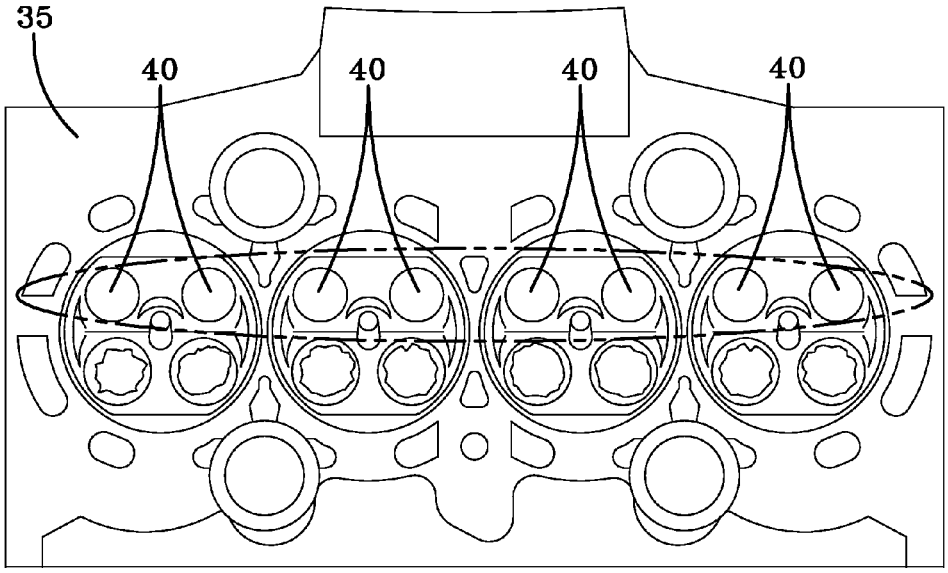
FIG. 1*b* illustrates a vehicle engine cylinder head cast using the core of FIG. 1*a*, wherein the exhaust ports of the cylinder head are unformed or only partially formed due to unintended displacement of the core during the casting operation.

As can be observed in FIG. 1*b*, displacement of the port core 5 from its proper position in the mold can result in undesirable consequences. In this case, port core displacement has resulted in flash over the exhaust passage openings 40 that should have been formed in the cylinder head 35.

Figure 2A:
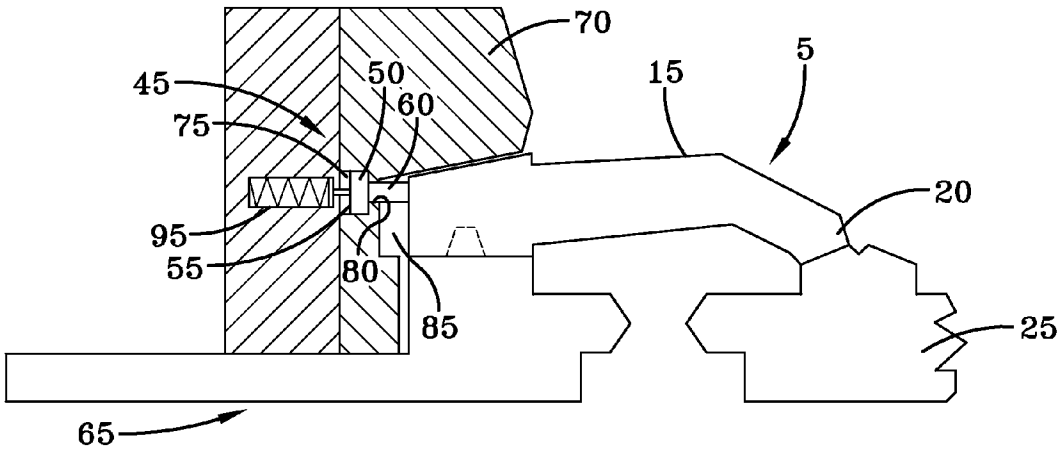
FIG. 2*a* schematically illustrates an exemplary core retention device of the present invention installed to a casting mold that is not quite fully closed.
Figure 2B:
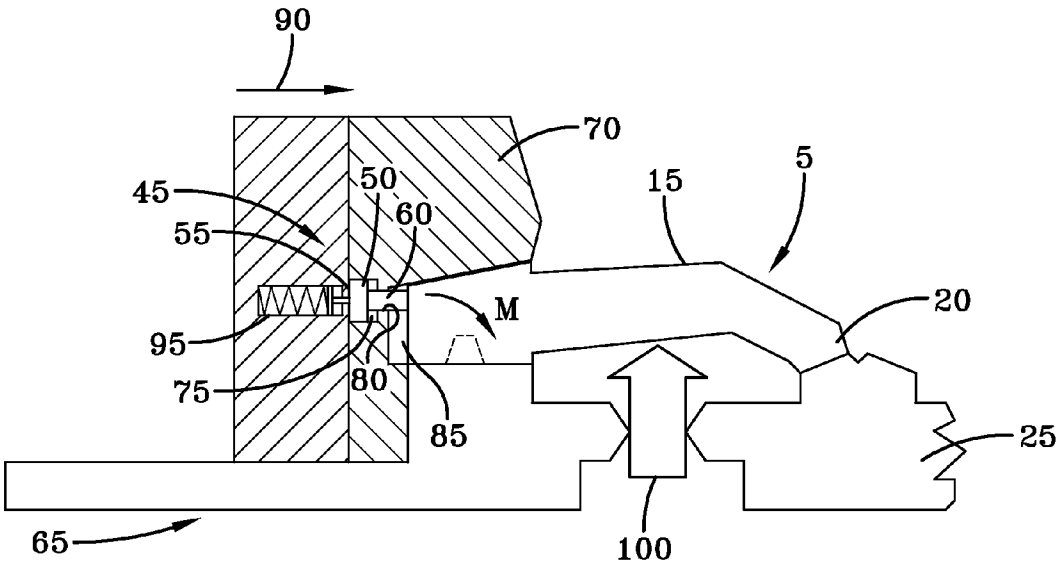
FIG. 2*b* shows the core retention device and casting mold of FIG. 2*a* with the mold fully closed.

One exemplary embodiment of a core retention device 45 of the present invention is schematically illustrated in FIGS. 2*a*-2*b*. As shown, the core retention device 45 includes a pin 50 that resides at least partially in a cavity 75 located within a moving section 70 of a cylinder head casting mold 65. The pin includes a proximal end 55 of enlarged diameter, which proximal end is trapped within the cavity 75 to permit unintended removal of the pin 50. An elongate portion 60 of the pin 50 extends from the proximal end 55 thereof and emerges through an opening 80 in the moving mold section 70 into a cavity area 85 provided to receive the neck portion 10 of the port core 5. By this arrangement, the pin 50 is retained in the moving mold section 70, but is free to reciprocate within the cavity 75 therein.

As shown in FIG. 2*a*, the pin 50 has just made initial contact with the port core 5 as a result of closing movement 90 of the moving mold section 70. Consequently, as shown in FIG. 2*a*, the pin 50 is in its normal state, which is biased in the direction of the cavity area 85. Generally, this biased position is fixed by contact between the proximal end 55 of the pin and a forward interior wall of the cavity 75.

Biasing of the pin 50 is preferably accomplished via a spring element 95 that is also located in the moving mold section 70 or a plate or other mold component associated therewith. The spring element 95 contacts the proximal end 55 of the pin 50 so as to bias (force) the pin toward the cavity area 85 of the mold 65. The pin 50 and spring element 95 combine to form the core retention device 45, in the form of a plunger assembly. The spring element 95 may be a coil spring, an elastomeric element, or any of various devices that would be apparent to one of skill in the art.

Referring now to FIG. 2*b*, it can be observed that as the moving mold section 70 moves to its closed (casting) position, contact between the port core 5 and the protruding elongate portion 60 of the pin 50 causes a compression of the spring element 95 and a retraction of the pin into the cavity 75. Preferably, the amount of pin movement is controlled to prevent the proximal end 55 of the pin 50 from making forceful contact with a rearward wall of the cavity 75 at the maximum point of retraction.

As can be understood from FIGS. 2*a*-2*b*, the core retention device 45 itself exerts a substantially unidirectional (horizontal in this case) pressing force, the magnitude of which is determined by the strength of the spring element 95. Due to the shape of the core and its orientation and arrangement with respect to the mold 65, however, the substantially unidirectional force of the core retention device 45 also creates a moment M that results in a non-horizontal (downward in this case) force component. This non-horizontal force component presses the contacting ends 20 of the port core runners 15 tightly against combustion chamber forming portions of the lower mold section 25.

The retention forces exerted on the port core 5 by the core retention device 45 resist movement of the port core 5 in a direction substantially parallel to the motion of the moving mold section 70. Further, the port core 5 is held tightly against supporting portions of the mold 65 and can therefore resist the counterforce produced when molten metal is introduced into the mold (as indicated by the arrow 100). Consequently, it can be ensured that floating of the core (vertical movement in this case) within the mold 65 during molten metal introduction is also eliminated or at least greatly minimized.

Figure 3A:
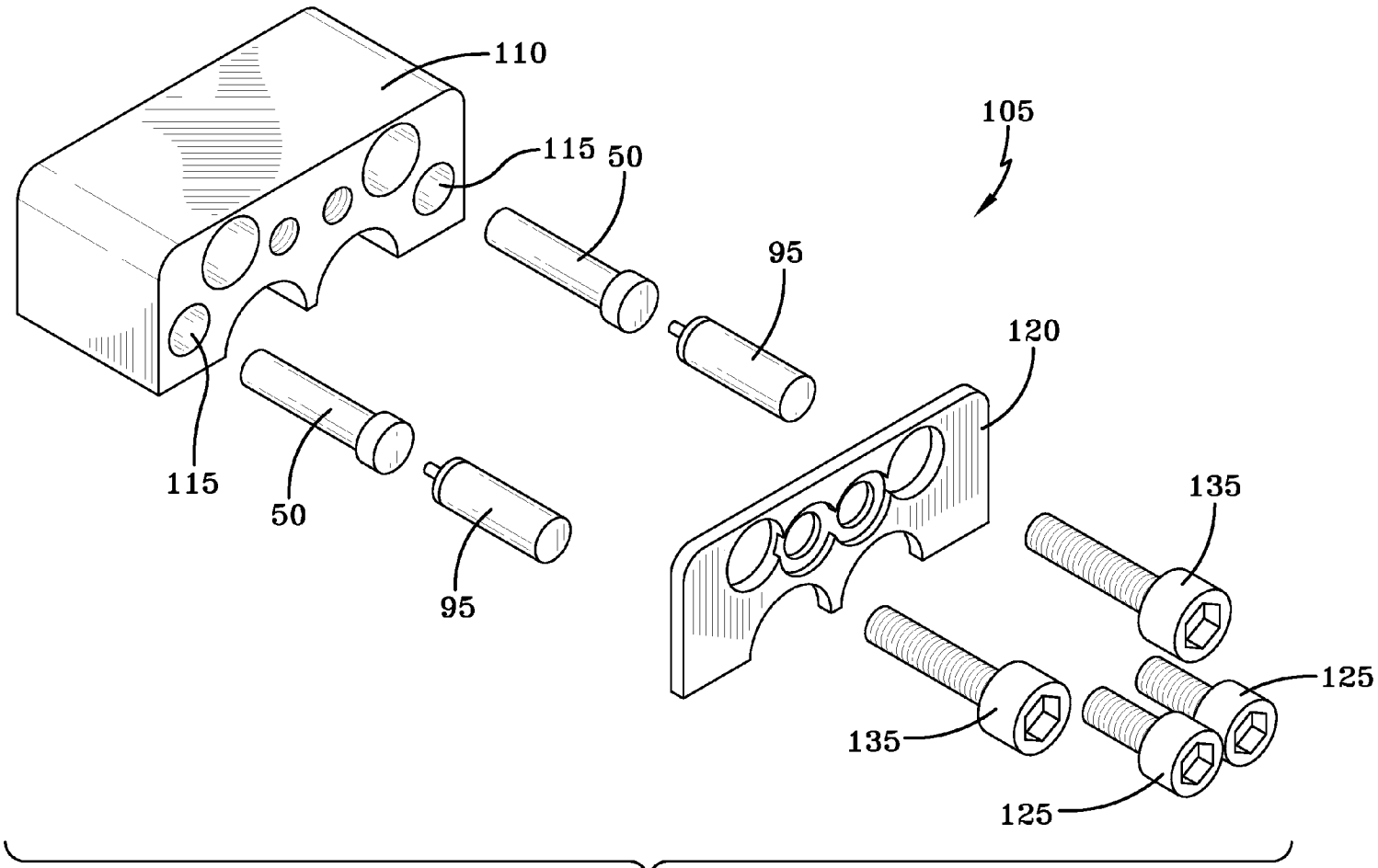
FIGS. 3*a*-3*c* depict an exemplary modular core retention device of the present invention.

While FIGS. 2*a*-2*b* depict the components of the core retention device 45 as being installed directly into a cavity in the mold 65, it is also possible that one or more core retention devices may be located in a module. An exemplary embodiment of such a core retention device module 105 is shown in FIGS. 3*a*-3*c*.

This particular embodiment of the core retention device module 105 includes a housing 110 for containing the various core retention device components. For example, a pin(s) 50 and a spring element(s) 95 may be located within appropriate cavities 115 in the housing 110, which cavities may be closed with a plate 120 secured to the housing with threaded fasteners 125, by any other technique that would be known to one of skill in the art. Installing the pin 50 and spring element 95 of FIGS. 2*a*-2*b* in the housing 110 results in some length of the elongate portion 60 of the pin extending from the housing, as can be observed in the assembled view of FIG. 3*b*. Two plunger assemblies are shown to be installed in this particular module 105, however, a greater or lesser number of plunger assemblies may be present in other embodiments.

Figure 3C:
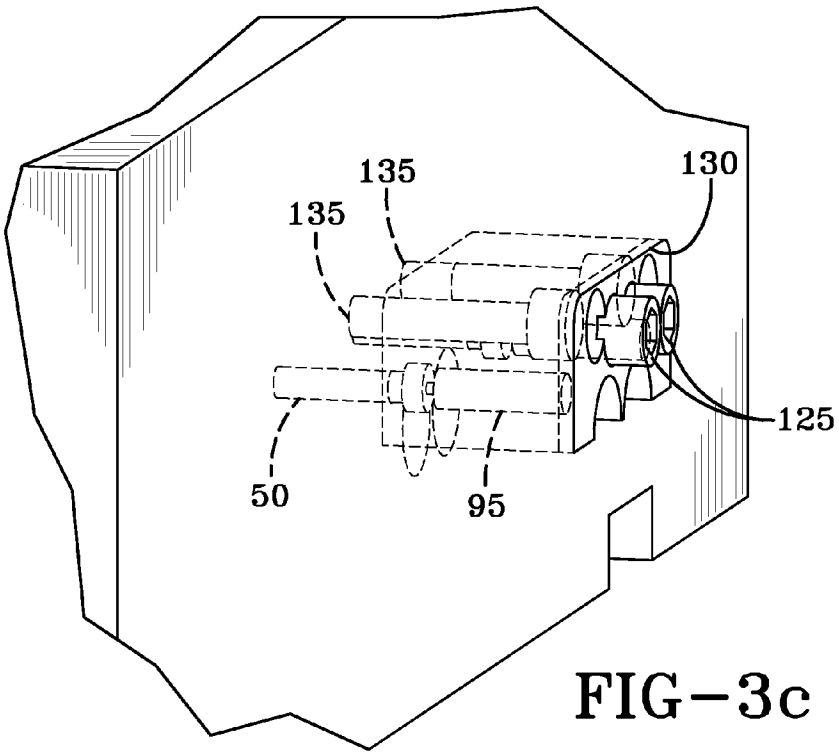
Figure 3B:
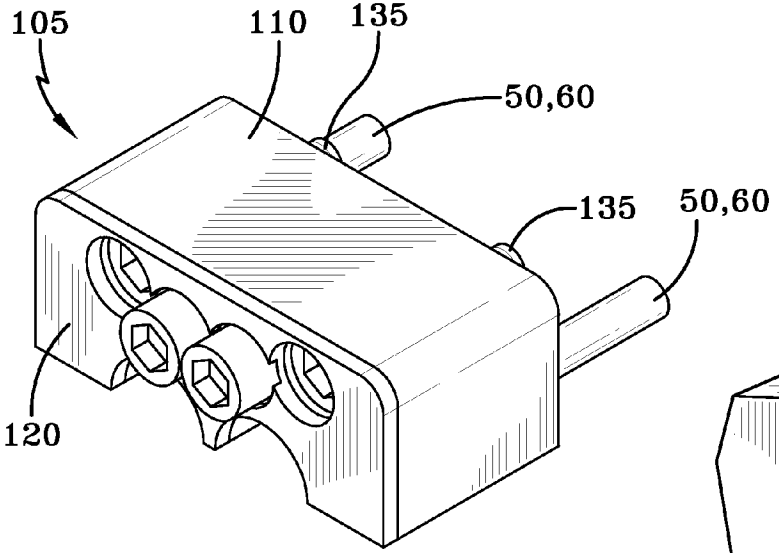

As illustrated by the transparent view of FIG. 3*c*, once the plunger assemblies are pre-installed to the housing 110, the core retention device module 105 is installed into an appropriately sized and shaped cavity 130 in a mold of interest, such that the pins 50 of the plunger assemblies will contact and act on an associated port core as described above with respect to the embodiment of FIGS. 2*a*-2*b*. In this particular embodiment, the module 105 is retained in the cavity 130 by a pair of threaded fasteners 135 that engage like-threaded holes in the mold.

As should be apparent to one of skill in the art, the use of a core retention device module may reduce the time required to change a plunger element or to remove and reinstall such plunger elements during maintenance, etc. More specifically, rather than removing/installing each individual component of a plunger assembly from/to a mold, the components may be part of a module that can be more easily assembled/disassembled and exchanged.

Exemplary embodiments of retention assistive features that may be applied to a port core and associated mold section according to the present invention are shown in FIGS. 4*a*-4*e*. As shown therein, the previously described and illustrated port core 5 and the associated combustion chamber forming portions of the lower mold section 25 are provided with complimentary engaging features. In this particular embodiment, the engaging features are shown to be a protrusion 140, 140' that extends from the combustion chamber forming portions of the lower mold section 25 and a corresponding receiving cavity 145, 145' in the contacting end 20 of the port core runners 15. As should be readily apparent, and as clearly illustrated in FIG. 4*e*, engagement of the protrusions 140, 140' and cavities 145, 145' helps to resist any translational movement between the core 5 and the lower mold section 25 during a casting operation. The protrusions 140, 140' may also help to locate the core runners 15 to the mold.

Figure 4A:
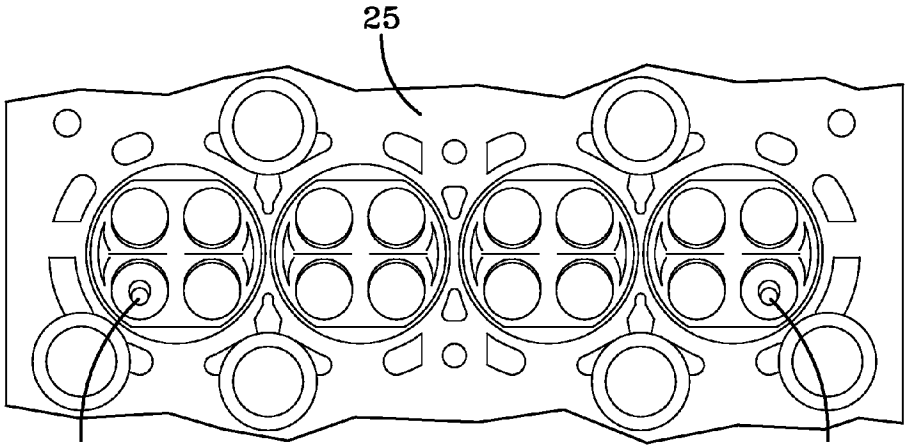
FIGS. 4*a*-4*e* depict an exemplary set of corresponding core retention features that may be associated with a core and casting mold to assist a device of the present invention with core retention.
Figure 4B:
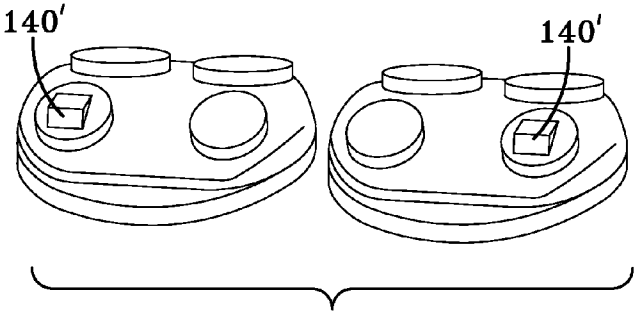
Figure 4C:
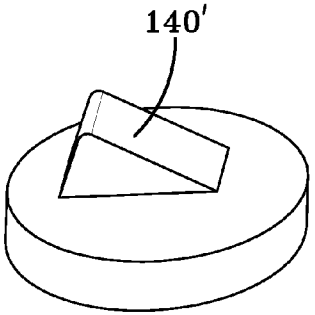
Figure 4E:
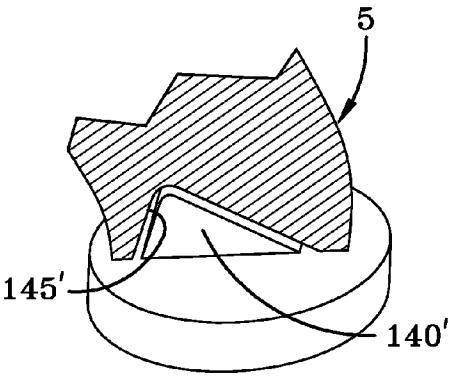
Figure 4D:
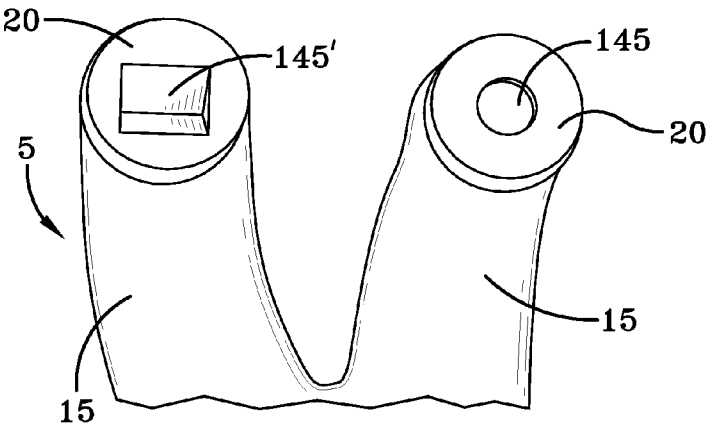

Although FIGS. 4*a*-4*e* show the protrusions 140, 140' to be located on the mold section 25 and the cavities 145, 145' to be located in the core runners 15, this arrangement could obviously be reversed, whether in whole or in part. Further, such engaging features are not limited to any particular shape. For example, a protrusion 140 of round shape is shown for purposes of illustration in FIG. 4*a*, while a protrusion 140' of substantially square shape is shown in FIGS. 4*b*-4*c* and in FIG. 4*e*. Other shapes are also possible. Cavities in the core runners 15 may be provided with a shape that corresponds to a selected protrusion shape, as evidenced by the round and square cavity shapes respectively associated with reference numbers 145 and 145' of FIG. 4*d*.

Each core runner and exhaust port forming portion of a mold may be provided with a complimentary engaging feature, or such features may be located on only certain ones of the core runners and exhaust port forming portions of a mold. While not essential to the successful use of a core retention device of the present invention, the use of such engaging features may create an overall retention system with improved core retention capabilities.

While certain exemplary embodiments of the present invention are described in detail above for purposes of illustration, it should be apparent that a core retention device of the present invention is not so limited in scope. For example, it may be possible to apply the same technique to a vehicle engine intake core, or to another type of core. Consequently, the scope of the present invention is not to be considered limited by the disclosure of exemplary embodiments provided herein, and modifications are possible without departing from the spirit of the invention as evidenced by the following claims:

What is claimed is:

1. A vehicle engine cylinder head casting device, comprising:

a plurality of mold sections that cooperate to form a closed casting mold during a casting operation;

a core residing within a core receiving cavity of the casting mold, the core supported at one end by at least one core support element of the mold and at the other end by contact with a molding surface; and a core retention device, the core retention device comprising:

a pin, the pin having a first end that is reciprocally restrained within a cavity of the mold and an opposite end that extends through an aperture in the mold to protrude into the core receiving cavity and to contact the core when the core is properly positioned in the mold and the mold is at least partially closed, and a spring element located within a cavity of the mold and in contact with the pin so as to bias the pin toward the core receiving cavity of the mold such that the pin exerts a pressing force on the core;

wherein the pin of the core retention device is oriented such that the direction of the pressing force exerted on the core will be substantially along a direction of closing mold movement so as to produce a first retention force component that resists core movement in a first direction; and wherein the pin of the core retention device is located to exert a pressing force on the core at a location that creates a moment about a supported end of the core, thereby producing a second retention force component that is substantially perpendicular to the direction of the pressing force exerted by the pin and resists core movement in a second direction.

2. The vehicle engine cylinder head casting device of claim 1, wherein the mold is a low pressure casting mold.

3. The vehicle engine cylinder head casting device of claim 1, wherein the core is a sand core.

4. The vehicle engine cylinder head casting device of claim 1, wherein the core is an exhaust port core that forms the exhaust passages in the cylinder head.

5. The vehicle engine cylinder head casting device of claim 4, wherein contacting surfaces at one end of the core contact corresponding combustion chamber forming features of the mold to form exhaust passage openings in combustion chamber portions of the cylinder head.

6. The vehicle engine cylinder head casting device of claim 1, wherein the direction of flow of molten metal upon introduction to the mold is substantially perpendicular to the direction of the pressing force exerted on the core by the pin.

7. The vehicle engine cylinder head casting device of claim 1, wherein the pin and spring element are contained within the housing of a module, the module installed in a corresponding cavity in the mold.

8. The vehicle engine cylinder head casting device of claim 1, wherein the depth of the cavity into which the first end of the pin is installed is selected such that the first end of the pin is not driven into a wall of the cavity by contact with the core upon full closure of the mold.

9. The vehicle engine cylinder head casting device of claim 1, further comprising at least one pair of complimentary engaging elements located between a molding surface of the mold and an associated contacting surface of the core, the engaging elements interacting to resist movement of the core during a casting operation.

10. The vehicle engine cylinder head casting device of claim 9, wherein one of the complimentary engaging elements is a protrusion and the other of the complimentary engaging elements is a receiving cavity.

11. A vehicle engine cylinder head casting device, comprising:

a plurality of mold sections that cooperate to form a closed casting mold during a casting operation;

a port core located within a core receiving cavity of the casting mold, the port core supported at a neck end thereof by an upright core support element of the mold and at the other end by contact with a molding surface, such that the port core resides in a substantially horizontal and suspended orientation within the core receiving cavity; and a core retention device, the core retention device comprising:

a plunger assembly including a pin and a spring element, the pin having a first end that is reciprocally restrained within a cavity of the mold and an opposite end that extends through an aperture in the mold to protrude into the core receiving cavity and to contact the neck end of the core when the core is properly positioned in the mold and the mold is at least partially closed, the spring element located within a cavity of the mold and in contact with the pin so as to bias the pin toward the core receiving cavity of the mold such that the pin presses against the core in a substantially horizontal direction and produces a first retention force component that resists core movement in a substantially horizontal direction;

wherein the pin of the core retention device is located such that the pressing force exerted on the core by the pin will create a moment about the neck end of the core, thereby producing a second retention force component that is substantially perpendicular to the direction of the first retention force component and resists core movement in a substantially vertical direction.

12. The vehicle engine cylinder head casting device of claim 11, wherein the mold is a low pressure casting mold.

13. The vehicle engine cylinder head casting device of claim 11, wherein the core is a sand core.

14. The vehicle engine cylinder head casting device of claim 11, wherein contacting surfaces at one end of the core contact corresponding combustion chamber forming features of the mold to form exhaust passage openings in combustion chamber portions of the cylinder head.

15. The vehicle engine cylinder head casting device of claim 11, wherein the direction of flow of molten metal upon introduction to the mold is substantially perpendicular to the orientation of the core.

16. The vehicle engine cylinder head casting device of claim 11, wherein the pin and spring element are contained within the housing of a module, the module installed in a corresponding cavity in the mold.

17. The vehicle engine cylinder head casting device of claim 11, further comprising at least one pair of complimentary engaging elements located between a molding surface of the mold and an associated contacting surface of the core, the engaging elements interacting to resist movement of the core during a casting operation.

18. The vehicle engine cylinder head casting device of claim 17, wherein one of the complimentary engaging elements is a protrusion and the other of the complimentary engaging elements is a receiving cavity.

19. A vehicle engine cylinder head casting device, comprising:

a plurality of mold sections that cooperate to form a closed casting mold during a casting operation;

an exhaust passage-producing port core located within a core receiving cavity of the casting mold, the port core supported at a neck end thereof by an upright core support element of the mold and at the other end by contact with a molding surface, such that the port core resides in a substantially horizontal and suspended orientation within the core receiving cavity; and a core retention device module, said module comprising:

a housing, a plunger assembly including a pin and a spring element, the pin having a first end that is reciprocally restrained within a cavity of the housing and a second end that extends through an aperture in the housing, the spring element located within a cavity of the housing so as to be in contact with the pin and to push the pin through the aperture in the housing, a cover plate secured to the housing to retain the plunger assembly therein, and a fastener for securing the module within a module receiving cavity created in the mold;

wherein, the module receiving cavity is located in the mold such that when the module is located in the module receiving cavity, the second end of the core retention device pin will extend into the core receiving cavity of the mold and contact the neck end of the core when the core is properly positioned in the mold and the mold is at least partially closed, and the core retention device spring element will press the core retention device pin against the core in a substantially horizontal direction so as to produce a first retention force component that resists core movement in a substantially horizontal direction; and wherein the core retention device pin is located such that the pressing force exerted on the core by the pin will create a moment about the neck end of the core, thereby producing a second retention force component that is substantially perpendicular to the direction of the first retention force component and resists core movement in a substantially vertical direction.

20. The vehicle engine cylinder head casting device of claim 19, further comprising at least one pair of complimentary engaging elements located between a molding surface of the mold and an associated contacting surface of the core, the engaging elements interacting to resist movement of the core during a casting operation.

* * * * *